US007121343B2

(12) United States Patent
Telfer

(10) Patent No.: US 7,121,343 B2
(45) Date of Patent: Oct. 17, 2006

(54) SELECTIVELY OPERATIONAL CLEANING TOOL

(75) Inventor: George Telfer, Aberdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 0 days.

(21) Appl. No.: 10/513,281

(22) PCT Filed: May 1, 2003

(86) PCT No.: PCT/GB03/01849

§ 371 (c)(1),
(2), (4) Date: Aug. 19, 2005

(87) PCT Pub. No.: WO03/093635

PCT Pub. Date: Nov. 13, 2003

(65) Prior Publication Data

US 2006/0108117 A1 May 25, 2006

(30) Foreign Application Priority Data

May 4, 2002 (GB) ..... 0210286.1

(51) Int. Cl.
*E21B 37/02* (2006.01)

(52) U.S. Cl. ..... 166/311; 166/174

(58) Field of Classification Search ..... 166/311, 166/174, 171, 173
See application file for complete search history.

(56) References Cited

U.S. PATENT DOCUMENTS

| | | | | |
|---|---|---|---|---|
| 206,242 | A * | 7/1878 | Jeannerat et al. | 166/112 |
| 2,857,141 | A * | 10/1958 | Carpenter | 175/270 |
| 4,291,764 | A | 9/1981 | Pampell | |
| 4,558,738 | A | 12/1985 | Howard, Sr. | |
| 4,671,355 | A * | 6/1987 | Strange | 166/171 |
| 5,351,758 | A | 10/1994 | Henderson et al. | |
| 6,152,221 | A | 11/2000 | Carmichael et al. | |

* cited by examiner

*Primary Examiner*—Hoang Dang
(74) *Attorney, Agent, or Firm*—C. Dean Dominque; Robert L. Waddell; Ted M. Anthony

(57) ABSTRACT

A downhole cleaning tool (10) for oil and gas wells. Brushes, scraper, wipers (32) and the like are mounted on a sleeve (14) over a tubular body (12), and the members successively moved towards and away from an inner surface of a tubular to be cleaned. Movement is created by a jarring action on the tool with the sleeve traveling over undulating profiles (26) on the body to actuate the cleaning members. The tool may be deployed on a slickline or wireline.

28 Claims, 3 Drawing Sheets

SELECTIVELY OPERATIONAL CLEANING TOOL

This patent application claims an international filing date 1 May 2003 and a priority date of 4 May 2002. The present invention relates to well cleaning apparatus and in particular, though not exclusively, to a well cleaning tool which is selectively operational within the well bore.

It is considered desirable during drilling and production of oil and gas that the walls of the tubing located within the well bore are kept clean and free of deposits and debris. For this purpose, well cleaning apparatus is well known for use in the drilling and completion of wells. Such apparatus typically includes scrapers, wipers and/or brushes which are held against the interior wall of the tubing to clean away debris as the tool is run in and pulled out of the well bore.

The majority of these tools have the cleaning members i.e. the scrapers, wipers, brushes and the like, biased outwards to ensure contact with the interior wall of the tubular. Such an arrangement has the disadvantage that the cleaning members may become stuck and jam the tool within the well bore requiring an expensive and time consuming fishing operation.

It would therefore be desirable to provide a cleaning tool which could be inserted into a well bore in a retracted or withdrawn position, expanded when required to provide cleaning at a desired location within a well bore and then retracted before removal from the well bore.

U.S. Pat. No. 2,216,674 discloses a well cleaner having pivotally mounted scraper blades. Selective operation of the blades is made by movement of a linear actuator including a raised portion against the blades. A disadvantage of this tool is that the actuator must abut the bottom of the well to effect movement of the actuator, thus the location and operation of the tool is limited.

U.S. Pat. No. 6,152,221 discloses a cleaning tool wherein the cleaning members are mounted on an expandable split sleeve. Radial movement of the cleaning members is achieved by movement of the sleeve on and/or off a shoulder on the mandrel. A disadvantage of this tool is that mechanical or hydraulic means must be provided to the sleeve to effect selective movement on and off the shoulder. A further disadvantage of this tool is that the surface area of the cleaning members are limited to the size of the portion of the sleeve which is expandable. As the cleaning members are mounted on the expandable sleeve the tool cannot achieve 360 degree cleaning of the tubular wall.

It is an object of the present invention to provide a cleaning tool which is selectively operational in a well bore and which obviates or mitigates at least some of the disadvantages of the prior art cleaning tools.

In particular, it is an object of the present invention to provide a cleaning tool which is selectively operational in a well bore and which does not require a hydraulic fluid feed to operate and does not require to be set down in the well bore.

It is a further object of at least one embodiment of the present invention to provide a selectively operational cleaning tool which can be deployed on a slickline or wireline.

It is a still further object of at least one embodiment of the present invention to provide a selectively operational cleaning tool which can be used to clean tubing in producing wells.

According to a first aspect of the present invention there is provided a selectively operational cleaning tool for use in cleaning the inner surface of tubulars, the tool comprising:

a tubular body attachable to a work string;

a sleeve located around the tubular body;

a plurality of cleaning members positioned relative to the sleeve;

actuating means to successively move the cleaning members between a retracted position such that the cleaning members do not contact the inner surface of the tubular and an expanded position such that the cleaning members are held against the inner surface to effect cleaning thereof; and a plurality of detachable coupling means between the body and the sleeve, to provide successive controlled movement of the sleeve and the body with respect to each other and thereby operate the actuating means.

The tool therefore operates by sequentially decoupling the sleeve and the body so that they move a fixed distance in relation to each other on each decouplement. The relative movement sequentially moves the cleaning members between a retracted position and an expanded position. Thus the tool can repeatedly expand and retract the cleaning members in a controlled manner.

According to a second aspect of the present invention there is provided a selectively variable cleaning tool for use in cleaning the inner surface of tubulars, the tool comprising:

a tubular body attachable to a work string;

a sleeve located around the tubular body;

a plurality of cleaning members positioned relative to the sleeve;

actuating means to move the cleaning members radially with respect to the sleeve and thereby selectively vary the force exerted by the cleaning members on the inner surface of the tubular effect cleaning thereof; and a plurality of detachable coupling means between the body and the sleeve, to provide successive controlled movement of the sleeve and the body with respect to each other and thereby operate the actuating means.

It will be appreciated that the term 'work string' includes tubing in the form of drill pipe, composites such as coiled tubing and cables, commonly referred to as slickline and wireline.

Preferably the sleeve includes a plurality of apertures through which the cleaning members may protrude. Preferably also each aperture includes a lip to limit the maximum radial movement of each cleaning member through the aperture.

Preferably the actuating mean comprises an undulating profile longitudinal arranged on the outer surface of the body. Thus when the body is moved, successive peaks and troughs of the profile locate at the cleaning members. Advantageously the sleeve and the body are arranged such that a spring is located at each cleaning member to contact the undulating profile. Preferably the spring is a flat spring which may be referred to as a linear expander. These springs operate through a small lateral movement providing a comparatively large force. Thus when a peak is located at a cleaning member, the cleaning member is forced through the aperture to contact the wall of the tubular. Similarly when a trough is located at a cleaning member, the cleaning member retracts into the sleeve towards the body sway from the wall of the tubular. Alternatively the troughs may be arranged so that the cleaning member remains in contact with the surface to be cleaned but now exerts a lower force on the surface. Thus the pads can be fully engaged or partially engaged on the surface of the tubular.

The use of a spring provides some flexibility on the pads so that they can ride over inner diameter restrictions in the tubular such as nipple profiles without jamming or sticking.

Preferably the detachable coupling means comprises a coupling member attached to the body or sleeve via a shearing means. The shearing means may be a pin. Preferably also the sleeve or body includes a face engageable with the coupling member such that force applied to the coupling member on contact with the face causes detachment of the coupling member by shearing of the shearing means. Preferably the coupling member is a ring arranged on the outer surface of the body or on the inner surface of the sleeve. Advantageously the face comprises a lip arranged on the inner surface of the sleeve or the outer surface of the body, respectively.

Preferably the tool further comprises a jar actuating sleeve and a corresponding lateral face. Preferably the jar actuating sleeve includes means for attachment to the work string. The means may provide attachment to a pipe, slickline, wireline, coiled tubing or the like. The lateral face may be located on a stop mounted upon the body. Further the sleeve may enclose the stop. Movement of the jar actuator sleeve against the face provides a jarring action on the body, setting up a shock wave. The action can be repeated until sufficient force is exerted in the shock wave to cause shearing of one of the detachable couplings.

Preferably the tubular body is a mandrel. The tubular body may include an inner bore to provide a passage for fluid flow through the tool.

Advantageously the tool includes a damper or brake. The damper/brake acts to prevent more than one detachable coupling being decoupled at a time.

Preferably the cleaning members are brushes, scrapers or the like which remove debris when moved against the inner surface of the tubular. Advantageously the cleaning members are arranged to provide a plurality of concentric cleaning pads longitudinally on the tool. Preferably also, the cleaning members are arranged to provide 360 degree, complete coverage of the outer surface of the sleeve so that the inner surface of the tubular is fully contacted if the tool is reciprocated in the well bore.

According to a third aspect of the present invention there is provided a method of cleaning the inner surface of a tubular located in a well bore, the method comprising the steps:

(a) mounting a cleaning tool on a work string, the cleaning tool including a plurality of cleaning members, the members being actuable downhole to selectively move radially with respect to a longitudinal axis of the tool;

(b) running the tool into the well bore; and (c) creating a jarring action on the tool to actuate the cleaning members and thereby vary the contact of the cleaning members on the inner surface of the tubular.

In a preferred embodiment, the work string is a slickline. Alternatively the work string may be pipe, coiled tubing, wireline or the like.

Preferably repetitive jarring actions are created to move the cleaning members a plurality of times within the well bore. The cleaning members may be moved such that they do not contact the inner surface of the tubular. Such movement would be advantageous if the tool became stuck in the well bore. Advantageously the cleaning members may be moved to vary the force exerted by the members on the inner surface. Thus in an embodiment, the cleaning members may lightly compress the inner surface as the tool is run in the well bore, be actuated downhole to exert a greater force on the inner surface, and remain in this heavily compressed position while the tool is pulled out of the well bore.

Preferably also the method may include the step of providing a brake or damper within the tool to limit the effect of the jarring action.

Preferably also the method includes the step of collecting debris removed from thee inner surface of the tubular. The debris may be collected in a debris/junk catcher mounted below the tool on the work string. Alternatively the debris may be collected by dislodging the debris into a fluid path for return to the surface of the well bore. Preferably the fluid path is production fluid from the well. Therefore the method may be used in live well bores during production.

An embodiment of the present invention will now be described, by way of example only, with reference to the following drawings of which:

Figure 1:
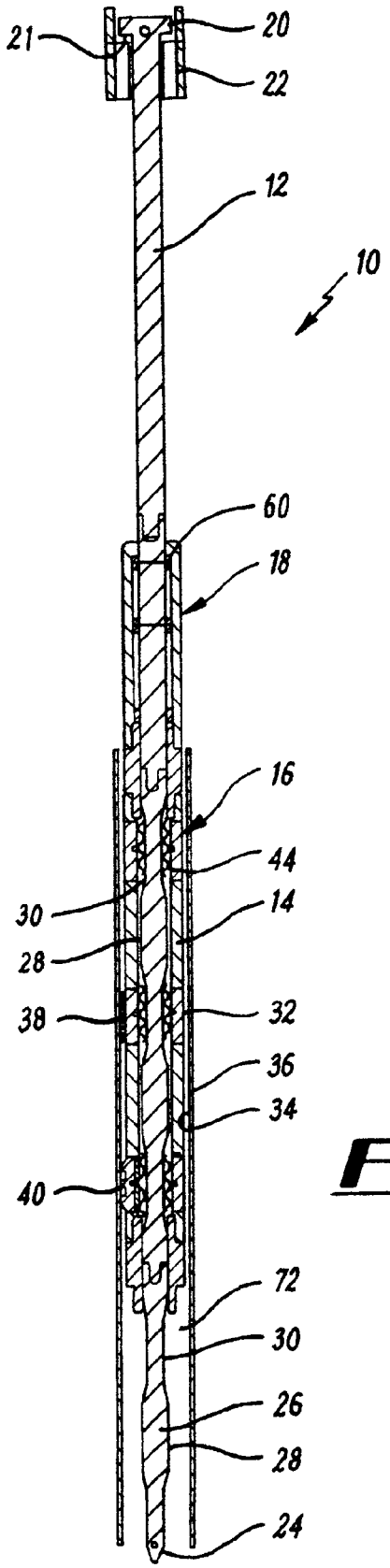
FIG. 1 is a schematic cross-sectional view of a cleaning tool according to the present invention.

Reference is initially made to FIG. 1 of the drawings which illustrates a cleaning tool, generally indicated by reference numeral 10, in accordance with an embodiment of the present invention. Cleaning tool 10 comprises a mandrel 12, a sleeve 14 mounted on the mandrel 12 including cleaning pads 32, an actuating mechanism, generally indicated by reference numeral 16 and detachable coupling means, generally indicated by reference numeral 18.

Mandrel 12 is shown as a rod; but could equally include a longitudinal bore for the passage of fluid internally through the tool 10. Mandrel 12 includes at an upper end a stop 20 providing a face 21 facing downhole. Located around and enclosing the stop 20 is a jar actuator sleeve 22. The body 12 and stop 20 can move longitudinally with respect to the sleeve 22. Jar actuator sleeve 22 is attached to a work string (not shown). Such a string could be a pipe, slickline, wire line, coil tubing or the like. In the embodiment shown the preferred string would be a slickline.

Towards a base 24 of the mandrel 12, the outer surface of the mandrel includes a surface profile 26 comprising an undulating arrangement of peaks 28 or plateaus and troughs 30. In the embodiment shown there are four peaks and four troughs. The profile 26 is created by varying the diameter of the mandrel 12. Alternatively, the profile 26 could be created by placing shoulders onto a mandrel.

Sleeve 14 is arranged over the profile 26 of the mandrel 12. Sleeve 14 supports cleaning pads 32 arranged to clean the inner surface 34 of a tubular 36. In the embodiment shown, three sets of pads 32 are illustrated and it will be understood that any number of sets could be arranged on the tool. Preferably each set of pads 32 are offset with respect to each other in a rotational direction so that reciprocation of the tool 10 within the tubular 36 affects cleaning around the entire circumference of the surface 34. In the preferred embodiment each set of pads 32 are offset in a rotational direction from neighbouring sets by 40 degrees. As shown in FIG. 1, the cleaning pads 32 may support any type of cleaning apparatus and in the Figure shown they may be bristles or brushes 38. Alternatively, they may be scrapers 40. Additionally, a combination of cleaning elements that can be used on the same tool 10.

Figure 2:
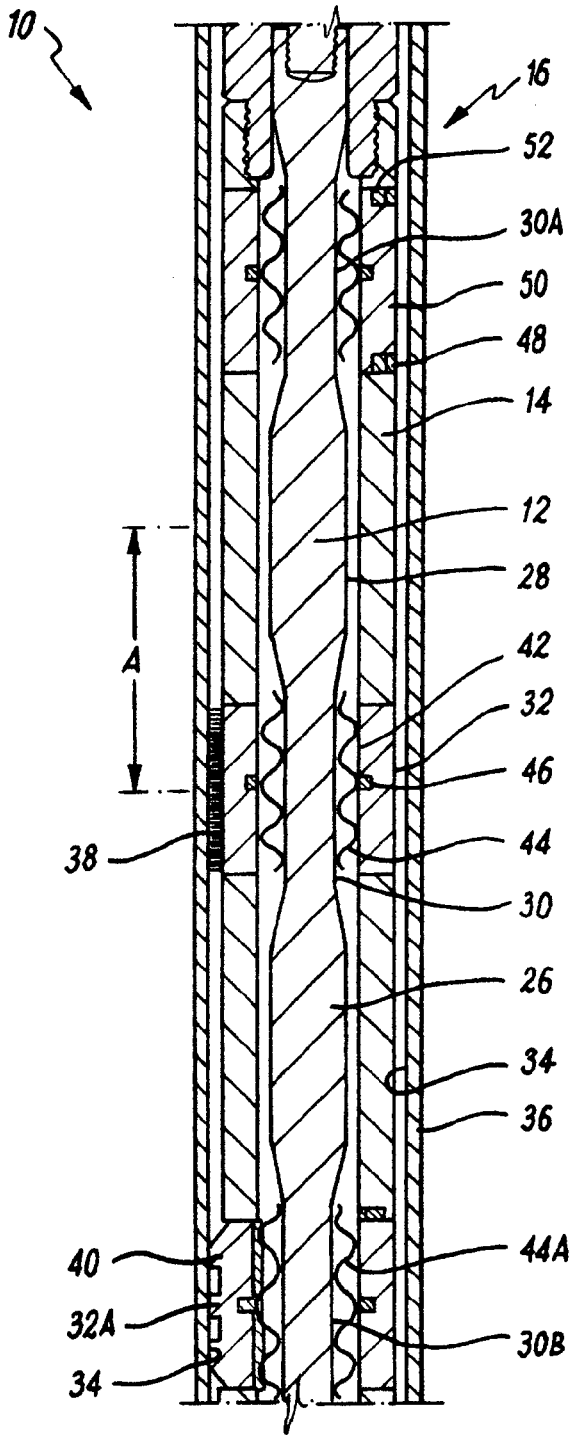
FIG. 2 is an expanded view of the actuating mechanism of the tool of FIG. 1.

The operation of the cleaning element 32 is best illustrated with the aid of FIG. 2. FIG. 2 shows the actuating mechanism 16 used in the tool 10. Each cleaning pad 32 has a spring 44 attached to a back surface 42. Spring 44 is a linear expander, as is known in the art. These springs provide a large force from a small movement of the spring. Spring 44 is attached to the pad 32 by means of a spring retainer 46 in the form of a screw. Thus the spring 44, is held in place by the retainer 46, but may be compressed or expanded depending on the distance between the back of the pad 42 and the surface of the undulating profile 26. In FIG. 2, it is illustrated that the spring 44 and pad 32 are located against a trough 30 of the mandrel 12. In this position, the pad 32 is held away from the inner surface 34 of the tubular 36.

When the mandrel 12 is moved a distance indicated as 'A' on the drawings, in either an upward or downward movement of the mandrel 12 relative to the sleeve 14, a peak 28 of the profile 26 will be located at the spring 44 of the cleaning pad 32. Due to the available space, the spring 44 will be compressed by the profile 26 such that the pad 32 will move radially outwards towards the inner surface 34 of the tubular 36. This movement will cause contact of the brushes 38 against the inner wall 34 and thus by movement of the tool 10, relative to the tubular 36 by reciprocation or rotation, debris can be cleaned from the inner surface 34 of the tubular 36.

By moving the mandrel 12 a further distance equal to the distance marked 'A', it can be seen that a subsequent trough 30A will now be located at the spring 44 and pad 32, thereby causing the pad 32 to be retracted back towards the mandrel 12. Contact with the inner surface 34 of the tubular 36 is then prevented. It will be appreciated that any number of consecutive movements over a distance 'A' will cause the pads to be selectively expanded or retracted from the mandrel 12.

FIG. 2 also illustrates a cleaning pad 32A including a scraper 40. In this embodiment when the spring 44A is located in a trough 30B, the cleaning element 32A abuts the inner surface 34 with a light compressive force. When the mandrel 12 is relocated by a distance 'A', the force exerted by spring 44A will increase the pressure exerted by the scrapers 40 on the inner surface 34 of the tubular 36. This embodiment is useful in that the tool may be run into the tubular 36 with the pads 32A lightly compressing the inner surface 34 of the tubular 36. This arrangement helps stabilise the tool as it is run into a well bore. When the tool 10 is pulled from the bore the pads 32A can be heavily compressed against the inner surface 34 of the tubular 36 such that cleaning occurs as the tool is run out of the hole. It will be appreciated, that by merely placing different cleaning elements upon the pads 32, 32A, the amount of cleaning action effected by each pad upon the inner surface 34 of the tubular 36 can be selected.

In order that the pad 32 remains within radial confinement to the sleeve 14, there is arranged a first lip 48 at the edge of the aperture 50 through which the cleaning pad 32 protrudes through the sleeve 14. Conversely, each pad 32 includes a second lip 52 which engages the first lip 48 when the pads 32 are at the maximum radial distance of travel from the mandrel 12.

Figure 3:
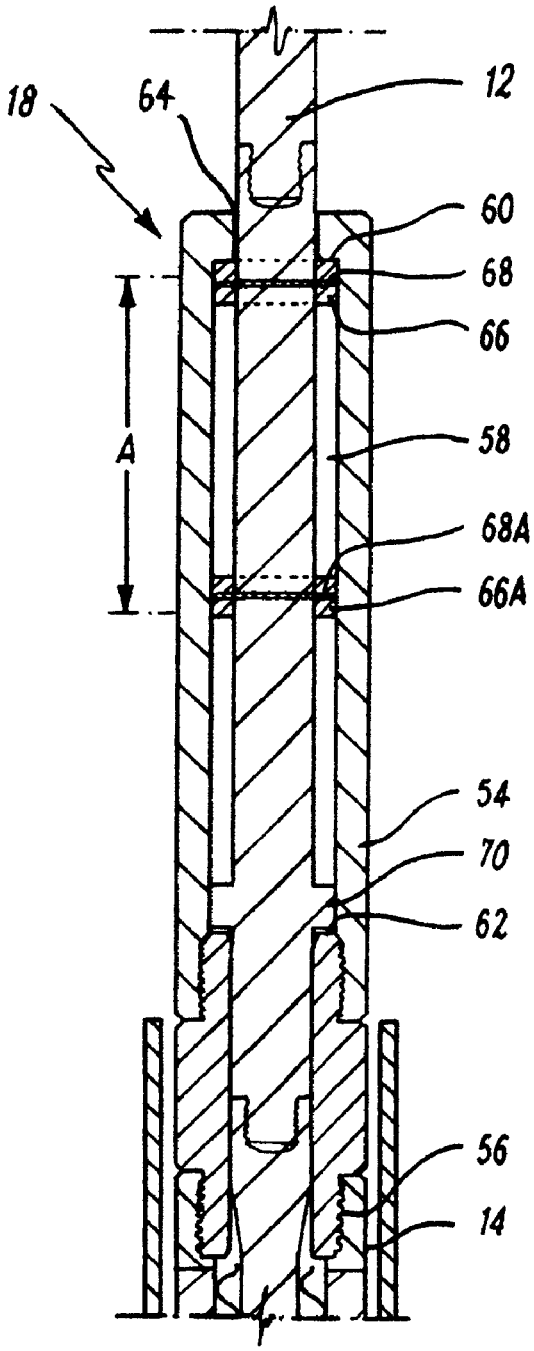
FIG. 3 is an expanded view of the detachable coupling mechanism of the tool of FIG. 1.

In order to move the mandrel 12 relative to the sleeve 14 by controlled distances marked 'A' on FIG. 2, the detachable coupling mechanism 18, as illustrated in FIG. 3, is used.

Detachable coupling mechanism 18 comprises a housing 54, attached to sleeve 14. The attachment is by a threaded connection 56. Housing 54 provides an enclosed space 58 around the mandrel 12. At an upper end of the housing 54, is provided a first abutment surface 60, while at lower end is a complementary second abutment surface 62. The clearance 64 between the housing 54 and the mandrel 12 is kept small. Located on the mandrel 12 are a number of rings 66. The rings 66 are spaced apart by distance equal to the distance 'A'. Each ring 66, is held to the mandrel by a shearing means such as a bissel pin, 68. It will be appreciated that any number of bissel pins may be arranged between the rings 66 and the mandrel 12. Also arranged on the mandrel 12 is a stop ring 70. Stop ring 70 has a permanent attachment to the mandrel and may be formed as an integral part of the mandrel if required.

To detachably couple the mandrel 12 to the sleeve 14, a ring 66 locates against the first abutment surface 60 of the housing 54. The ring 66 can support the weight of the sleeve as the tool 10 is carried into the well. Pads 32 located in light compression against the inner surface 34 of the tubular 36 may also provide support when the tool 10 is operated from a wireline or slickline. To detach the coupling, a force is inserted upon the surface 60 such that the ring 66 abutting the surface is caused to shear from the mandrel 12. The shear is caused by the breaking of the bissel pin 68. When the pin 68 is sheared, the ring 66 becomes free from the mandrel 12 and thus drops and locates against an adjacent ring 66A. At the same time as the ring 66 drops, the housing 54 and with it the sleeve 14 will move relative to the mandrel 12. The mandrel 12 and sleeve 14 will move by the relative distance 'A', thereby relocating the peaks 28 and troughs 30 of the profile 26, behind the springs 44 and the cleaning members 32. This process can be repeated by creating a further jarring force at the surface 60 to shear the bissel pin 68A of the next ring. Thus, rings 66, 66A will now equivalently drop and with then the housing 54 and sleeve 14 will move once again a distance 'A' relative to the mandrel 12.

It will be appreciated that although only two rings 66, 66A are shown in the FIG. 3, any number of rings may be located within the housing, 54. The distance between adjacent rings provides the distance on which the sleeve and mandrel will move with respect to each other. When the final ring 66A has been sheared, all rings will come to rest against the stop ring 70.

A further feature of the decoupling mechanism 18 is a damper or break. The damper occurs as fluid or air is trapped within the enclosed space 58. When the rings 66 and housing 54 move relative to the mandrel 12, the jarring action is prevented from causing multiple shearing of consecutive bissel pins 68, 68A by the dampening reaction from the air or fluid within the space 58. The air or fluid can slowly escape through the clearance 64, and this improves the dampening or braking effect between each movement of the mandrel/sleeve.

In use, tool 10 is attached to a string by attachment 20 and run into a well bore through tubular 36. As can be seen from FIG. 2 during run in, the pads 32 are preferentially located against a trough 30 of the mandrel 12. In this position, the pads 32 may be arranged so that they are not in contact with the inner surface 34 of the tubular 36 or alternatively, they may be in light compression on the inner surface 34. When the tool has reached a location in the well where cleaning is to be conducted, the work string is lowered and raised to cause the stop 20 to move within the jar actuator sleeve 22. As a result the jar actuator sleeve 22 is rammed against the face 21. This collision sets up a shock wave down the mandrel 12 to cause a jarring action at the surface 60 within the coupling mechanism 18. The jarring action causes shearing of a bissel pin 68 on a ring 66. When the ring 66 is sheared from the mandrel 12, this allows movement of the mandrel 12 relative to the sleeve 14 over a fixed distance 'A' dictated by the distance between consecutive rings located on the mandrel 12. This movement over a fixed distance causes the troughs 30 to move away from the springs 44 causing peaks or plateaus 28 to be located behind the springs 44. The springs 44 are thereby compressed. This movement in a radial direction will cause a strong force to be exerted on the back surface 42 of the pads 32. The pads 32 will therefore move radially from the mandrel, a distance limited by the co-operation of first and second lips, 48, 52. The cleaning pads 32 and in particular the brush 38 or a scraper 40 will be compressed onto the inner surface 34 of the tubular 36. Rotation or reciprocation of the tool 10, in the tubular 36 will affect cleaning of the inner surface 34 by the cleaning elements 38, 40 on the pads 32.

When the tool is to be retrieved from the well bore, if cleaning is not required during the removal of the tool, the jar actuator sleeve 22, can be made to collide with a nut 20, again, to cause a jarring action. This action will cause the subsequent shearing of a ring 66 from the mandrel 12 to move the springs 44 into troughs 30 on the mandrel 12. In this position, the force on the cleaning pad 32 is reduced such that the pads 32 may be retracted from the inner surface 34 of the tubular 36.

It will be appreciated by those skilled in the art that as the debris is dislodged from the inner surface 34 of the tubular 36, it may be caught by a debris catcher or junk catcher on the tool 10 located below the base 24.

Alternatively, in addition, the debris may be carried out of the well by fluid 72 located in the tubular 36. In a preferred embodiment the fluid 72 is production fluid such that the debris may be carried out of a well during production.

A principal advantage of the present invention is that it provides a cleaning tool giving repeatedly selective operation within a well bore.

A further advantage of the present invention is that it provides a cleaning tool wherein the cleaning pads may be sufficiently retracted from the walls of the well bore so that the tool may be easily removed in cases where the tool or cleaning members could become jammed or stuck in the well bore.

A yet further advantage of the tool is that o-rings are not required within the construction as no seals are used thus removing a major source of failure in downhole tools.

A yet further advantage of the present invention is that it provides a cleaning tool which may be run from a slickline or wireline so that it can be inserted quickly into a well. In this regard, the tool may be advantageously used within producing wells where the producing fluid will help carry the debris dislodged from the inner walls, from the well.

It will be appreciated by those skilled in the art that various modifications may be made to the invention herein disclosed without departing from the scope thereof. For example, the linear expander springs could be replaced by a set of compressive springs attached to the back surface of the cleaning pads. Further, the undulating profile on the mandrel could be arranged as a series of sloping sections such that the force applied on the cleaning pads could be made variable with respect to their force on an inner wall of the tubular. Further, it will be appreciated in the embodiment shown, the shearing means i.e. bissel pins were located on rings attached to the mandrel. Alternatively, the shearing means may be located between the housing and the rings.

The invention claimed is:

1. A selectively operational cleaning tool for use in cleaning the inner surface of tubulars, the tool comprising: a tubular body attachable to a work string; a sleeve located around the tubular body; a plurality of cleaning members positioned relative to the sleeve; actuating means to successively move the cleaning members between a retracted position such that the cleaning members do not contact the inner surface of the tubular and an expanded position such that the cleaning members are held against the inner surface to effect cleaning thereof; and a plurality of detachable coupling means between the body and sleeve, to provide successive controlled movement of the sleeve and the body with respect to each other and thereby operate the actuating means.

2. A selectively variable cleaning tool for use in cleaning the inner surface of tubulars, the tool comprising: a tubular body attachable to a work string; a sleeve located around the tubular body; a plurality of cleaning members positioned relative to the sleeve; actuating means to move the cleaning members radially with respect to the sleeve and thereby selectively vary the force exerted by the cleaning members on the inner surface of tubular effect cleaning thereof; and a plurality of detachable coupling means between the body and the sleeve, to provide successive controlled movement of the sleeve and the body with respect to each other and thereby operate the actuating means.

3. A cleaning tool as claimed in claim 2 wherein the sleeve includes a plurality of apertures through which the cleaning members protrude.

4. A cleaning tool as claimed in claim 3 wherein each aperture includes a lip to limit the maximum radial movement of each cleaning member through the aperture.

5. A cleaning tool as claimed in claim 2 wherein the actuating means comprises an undulating profile longitudinal arranged on an outer surface of the body.

6. A cleaning tool as claimed in claim 5 wherein the sleeve and the body are arranged with a spring located at each cleaning member to contact the undulating profile.

7. A cleaning tool as claimed in claim 2 wherein the detachable coupling means comprises a coupling member attached to the body via a shearing means.

8. A cleaning tool as claimed in claim 7 wherein the sleeve includes a face engageable with the coupling member such that force applied to the coupling member on contact with the face causes detachment of the coupling member by shearing of the shearing means.

9. A cleaning tool as claimed in claim 8 wherein the coupling member is a ring arranged on the outer surface of the body.

10. A cleaning tool as claimed in claim 9 wherein the face comprises a lip arranged on the inner surface of the sleeve.

11. A cleaning tool as claimed in claim 2 wherein the detachable coupling means comprises a coupling member attached to the sleeve via a shearing means.

12. A cleaning tool as claimed in claim 11 wherein the body includes a face engageable with the coupling member such that force applied to the coupling member on contact with the face causes detachment of the coupling member by shearing of the shearing means.

13. A cleaning tool as claimed in claim 12 wherein the coupling member is a ring arranged on the inner surface of the sleeve.

14. A cleaning tool as claimed in claim 13 wherein the face comprises a lip arranged on the outer surface of the body.

15. A cleaning tool as claimed in claim 2 wherein the tool further comprises a jar actuating sleeve and a corresponding lateral face.

16. A cleaning tool as claimed in claim 15 wherein the jar actuating sleeve includes means for attachment to the work string.

17. A cleaning tool as claimed in claim 16 wherein the lateral face is located on a stop mounted upon the body.

18. A cleaning tool as claimed in claim 16 wherein the lateral face is located on stop mounted on the sleeve.

19. A cleaning tool as claimed in claim 2 wherein the tubular body includes an inner bore to provide a passage for fluid flow through the tool.

20. A cleaning tool as claimed in claim 2 wherein the tool includes a damper/brake.

21. A cleaning tool as claimed in claim 2 wherein the cleaning members are arranged to provide a plurality of concentric cleaning pads longitudinally on the tool.

22. A method of cleaning the inner surface of a tubular located in a well bore, the method comprising the steps:

a) mounting a cleaning tool on a work string, the cleaning tool including a plurality of cleaning members, the members being actuable downhole to selectively move radially with respect to a longitudinal axis of the tool;

b) running the tool into the well bore; and c) creating a jarring action on the tool to actuate the cleaning member and thereby vary the contact of the cleaning members on the inner surface of the tubular.

23. A method as claimed in claim 22 wherein repetitive jarring actions are created to move the cleaning members a plurality of times within the well bore.

24. A method as claimed in claim 23 wherein the cleaning members are moved such that they do not contact the inner surface of the tubular.

25. A method as claimed in claim 23 wherein the cleaning members lightly compress the inner surface as the tool is run in the well bore, are actuated downhole to exert a greater force on the inner surface, and remain in this heavily compressed position while the tool is pulled out of the well bore.

26. A method as claimed in claim 22 wherein the method includes the step of providing a brake/damper within the tool to limit the effect of the jarring action.

27. A method as claimed in claim 22 wherein the method includes the step of collecting debris removed from the inner surface of the tubular.

28. A method as claimed in claim 27 wherein the debris is collected by dislodging the debris into a production fluid path for return to the surface of the well bore.

* * * * *